US011352152B2

(12) United States Patent
Mustonen et al.

(10) Patent No.: US 11,352,152 B2
(45) Date of Patent: Jun. 7, 2022

(54) STRETCH-WRAPPING MACHINE WITH SELF-ADJUSTING PINCH ROLLERS

(71) Applicant: Signode Industrial Group LLC, Glenview, IL (US)

(72) Inventors: Pekka Mustonen, Turku (FI); Yrjö Suolahti, Mynämäki (FI); Niko Aarras, Turku (FI)

(73) Assignee: Signode Industrial Group LLC, Tampa, FL (US)

( * ) Notice: Subject to any disclaimer, the term of this patent is extended or adjusted under 35 U.S.C. 154(b) by 86 days.

(21) Appl. No.: 17/011,367

(22) Filed: Sep. 3, 2020

(65) Prior Publication Data

US 2021/0086926 A1 Mar. 25, 2021

Related U.S. Application Data

(60) Provisional application No. 62/903,180, filed on Sep. 20, 2019.

(51) Int. Cl.

| | |
|---|---|
| ***B65B 11/02*** | (2006.01) |
| ***B65B 41/16*** | (2006.01) |
| ***B65B 11/00*** | (2006.01) |
| ***B65B 11/58*** | (2006.01) |

(52) U.S. Cl.

CPC ..... *B65B 11/025* (2013.01); *B65B 41/16* (2013.01); *B65B 11/008* (2013.01); *B65B 11/585* (2013.01); *B65B 2011/002* (2013.01); *B65B 2210/16* (2013.01)

(58) Field of Classification Search

CPC ... B65B 11/008; B65B 11/025; B65B 11/585; B65B 41/12; B65B 41/16; B65B 2011/002; B65B 2210/14; B65B 2210/16; B65B 2210/18

USPC ..... 53/556, 588, 210, 389.4

See application file for complete search history.

(56) References Cited

U.S. PATENT DOCUMENTS

| | | | | |
|---|---|---|---|---|
| 3,656,386 A * | 4/1972 | Roussel | B65B 41/12 | 83/367 |
| 5,077,956 A * | 1/1992 | Thimon | B65B 11/025 | 53/399 |
| 5,285,891 A | 2/1994 | Keip | | |
| 5,611,194 A * | 3/1997 | Wildmoser | B65B 43/123 | 53/562 |
| 5,875,616 A * | 3/1999 | Paavola et al. | B65B 11/025 | 53/556 |

(Continued)

FOREIGN PATENT DOCUMENTS

| | | | |
|---|---|---|---|
| EP | 0220712 A1 * | 5/1987 | B65B 11/025 |
| EP | 621184 A1 * | 10/1994 | B65B 41/16 |
| JP | 05124605 A * | 5/1993 | B65B 11/025 |

OTHER PUBLICATIONS

Extended European Search Report and Search Opinion for EP Application 20195981.4, dated Dec. 18, 2020.

*Primary Examiner* — Stephen F. Gerrity

(74) *Attorney, Agent, or Firm* — Neal, Gerber & Eisenberg LLP

(57) ABSTRACT

Various embodiments of the present disclosure provide a stretch-wrapping machine with self-adjusting pinch rollers configured to reorient themselves to compensate for misalignment relative to their respective pre-stretch rollers. This ensures the pinch rollers press the entire width of the film against their respective pre-stretch rollers as the film is drawn through the rollers.

14 Claims, 10 Drawing Sheets

(56) References Cited

U.S. PATENT DOCUMENTS

| | | | |
|---|---|---|---|
| 6,598,379 | B2 | 7/2003 | Zitella et al. |
| 6,694,712 | B2 | 2/2004 | Suolahti |
| 6,848,240 | B2 | 2/2005 | Frey |
| 6,910,315 | B2 | 6/2005 | Suolahti |
| 6,945,018 | B2 | 9/2005 | Suolahti |
| 7,055,299 | B2 | 6/2006 | Suolahti et al. |
| 7,107,743 | B2 | 9/2006 | Suolahti |
| 7,178,317 | B1 | 2/2007 | Koskela |
| 7,533,515 | B1 | 5/2009 | Koskela |
| 7,540,128 | B2 | 6/2009 | Lancaster, III et al. |
| 7,707,802 | B2 | 5/2010 | Forrest |
| 7,854,105 | B2 | 12/2010 | Zitella et al. |
| 8,453,420 | B2 | 6/2013 | Schmidt et al. |
| 10,138,012 | B2 | 11/2018 | Koskela et al. |

* cited by examiner

STRETCH-WRAPPING MACHINE WITH SELF-ADJUSTING PINCH ROLLERS

PRIORITY CLAIM

This application claims priority to and the benefit of U.S. Provisional Patent Application No. 62/903,180, which was filed on Sep. 20, 2019, the entire contents of which are incorporated herein by reference.

FIELD

The present disclosure relates to stretch-wrapping machines, and more particularly to stretch-wrapping machines that include self-adjusting pinch rollers.

BACKGROUND

Several types of known stretch-wrapping machines use stretch wrap to secure loads of goods on pallets. These stretch-wrapping machines include a film carriage to which a roll of stretch film is mounted. The film carriage rotates relative to the load while vertically moving relative to the load to wrap the load with the stretch film in a spiral pattern. For instance, a turntable wrapping machine rotates a turntable on which the load is positioned while vertically moving the film carriage to wrap the load with the stretch film in a spiral pattern. A ring wrapping machine rotates the film carriage on a circular ring that circumscribes the load while vertically moving the film carriage to wrap the load with the stretch film in a spiral pattern. A rotating arm wrapping machine rotates a cantilevered arm carrying the film carriage around the load while vertically moving the film carriage to wrap the load with the stretch film in a spiral pattern.

SUMMARY

Various embodiments of the present disclosure provide a stretch-wrapping machine with self-adjusting pinch rollers configured to reorient themselves to compensate for misalignment relative to their respective pre-stretch rollers. This ensures the pinch rollers press the entire width of the film against their respective pre-stretch rollers as the film is drawn through the rollers.

Various embodiments of the present disclosure provide a wrapping machine comprising: a wrapping-machine frame; a guide mounted to the wrapping machine frame; a guide actuator operably connected to the guide to move the guide vertically relative to the wrapping-machine frame; a wrapping assembly mounted to the guide and comprising a film carriage; and a wrapping-assembly actuator operably connected to the wrapping assembly to move the wrapping assembly relative to the guide. The film carriage comprises a film-carriage frame; a first pre-stretch roller rotatably mounted to the film-carriage frame; a first pinch-roller assembly comprising an arm and a first pinch roller having a first-pinch-roller rotational axis; and a first biasing element biasing the first pinch roller to an engaged position. The first pinch roller is connected to the arm so: (1) the first pinch roller is rotatable relative to the arm about the first pinch roller rotational axis; and (2) the first pinch roller is pivotable relative to the arm to pivot the first-pinch-roller rotational axis relative to the arm. The first pinch-roller assembly is pivotably mounted to the film-carriage frame by the arm so the first pinch roller is pivotable relative to the first pre-stretch roller between its engaged position in which the first pinch roller engages the first pre-stretch roller and a disengaged position in which the first pinch roller is disengaged from the first pre-stretch roller.

DETAILED DESCRIPTION

Figure 1:
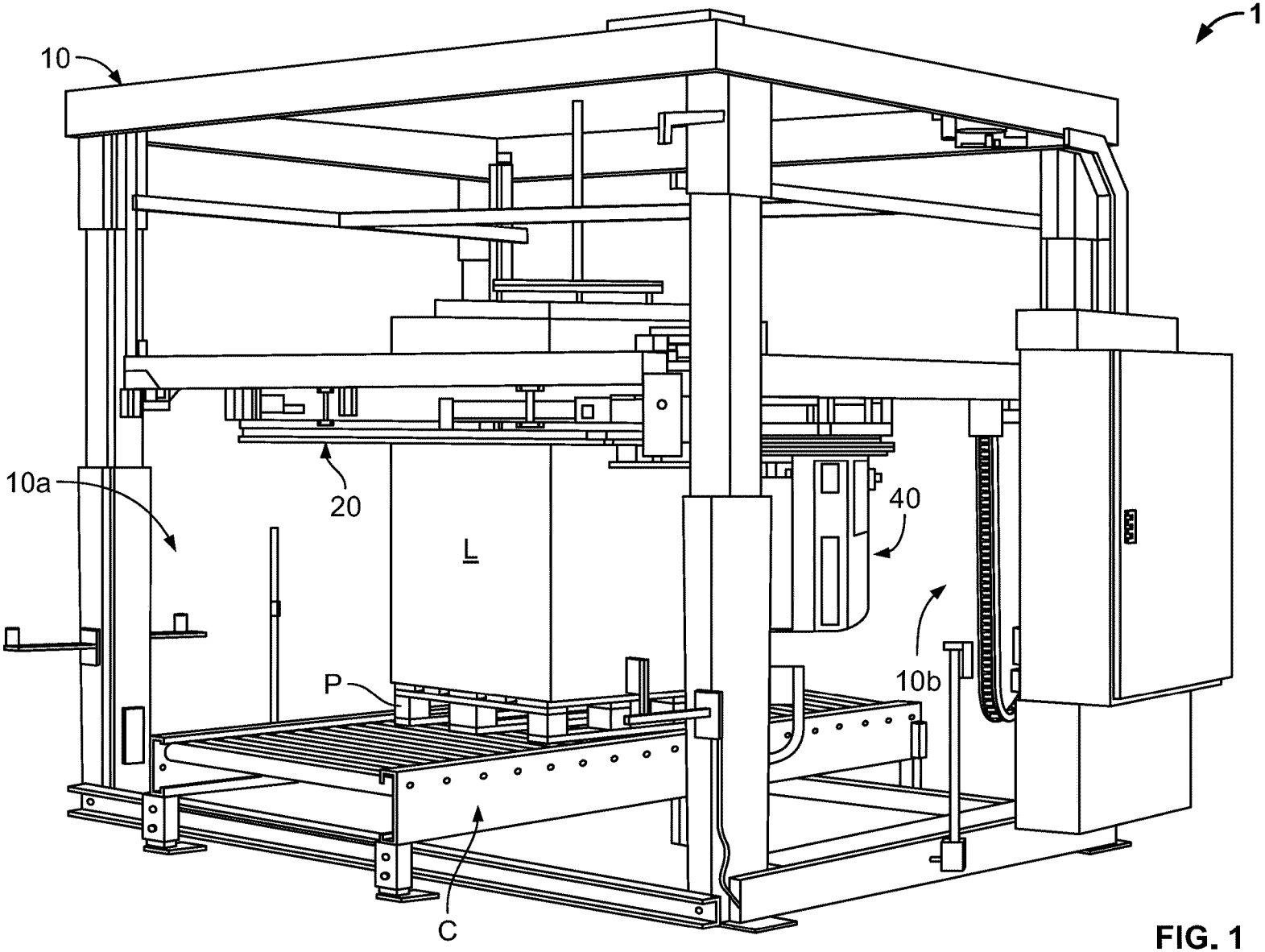
FIG. 1 is a perspective view of one example embodiment of a stretch-wrapping machine of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Figure 2:
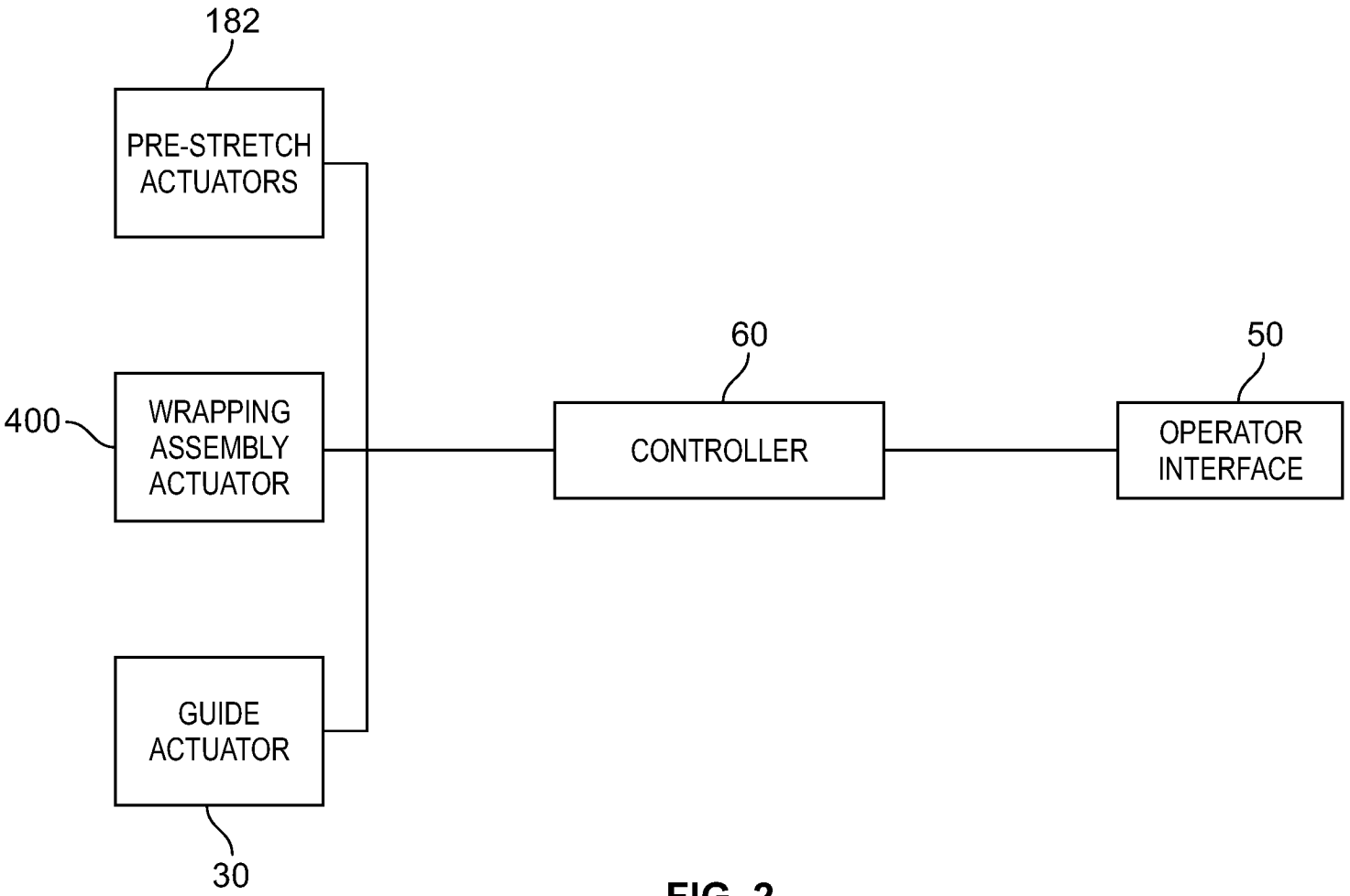
FIG. 2 is a block diagram showing certain components of the stretch-wrapping machine of FIG. 1.

Various embodiments of the present disclosure provide a stretch-wrapping machine with self-adjusting pinch rollers configured to reorient themselves to compensate for misalignment relative to their respective pre-stretch rollers. This ensures the pinch rollers press the entire width of the film against their respective pre-stretch rollers as the film is drawn through the rollers. FIGS. 1 and 2 show one embodiment of the stretch-wrapping machine 1 (sometimes referred to herein as the "wrapping machine" for brevity) of the present disclosure. The wrapping machine 1 includes a wrapping-machine frame 10, a circular guide 20, a guide actuator 30, a wrapping assembly 40, a cutting-and-fixing device (not shown), an operator interface 50, and a controller 60.

The wrapping-machine frame 10 is formed from multiple tubular and/or solid members (not individually labeled) and configured to support the other components of the wrapping machine 1. The wrapping-machine frame 10 defines a wrapping area within its interior and has an infeed area 10*a* at which a palletized load (such as a load L on a pallet P) is conveyed (such as via a conveyor C) into the wrapping area for wrapping and an outfeed area 10*b* at which the palletized load is conveyed (such as via the conveyor C) from the wrapping area after wrapping. The illustrated wrapping-machine frame 10 is merely one example configuration, and any suitable configuration may be employed.

The circular guide 20 serves as the mount for the wrapping assembly 40 and is movably mounted to the wrapping-machine frame 10 (such as to one or more vertical members of the wrapping-machine frame 10) such that the circular guide 20 is vertically movable relative to the wrapping-machine frame 10 between an upper position and a lower position.

The guide actuator 30 is operably connected to the circular guide 20 to move the circular guide 20 relative to the wrapping-machine frame 10 between the upper and lower positions. In certain embodiments, the guide actuator 30 includes one or more motors operably connected to the circular guide 20 via one or more belt-and-pulley assemblies to move the circular guide 20 between the upper and lower positions. In other embodiments, the guide actuator 30 includes one or more pneumatic or hydraulic cylinders operably connected to the circular guide 20 to move the circular guide 20 between the upper and lower positions. There are merely examples, and the guide actuator 30 may include any suitable actuator configured to move the circular guide 20 between the upper and lower positions.

The wrapping assembly 40 is movably mounted to the circular guide 20 such that the wrapping assembly 40 is rotatable relative to the circular guide 20. The wrapping assembly 40 includes a ring-shaped support (not shown), a film carriage 100, and a wrapping-assembly actuator 400 (FIG. 2).

The ring-shaped support serves as the mount for the film carriage 100 and is movably mounted to the circular guide 20 such that the support (and the carriage and other components connected to the support) is rotatable relative to the circular guide 20. In this example embodiment, the support is movably mounted to the circular guide 20 via multiple spaced-apart rollers (not shown) that are connected to the support and positioned on a track (not shown) on the circular guide 20.

Figure 5:
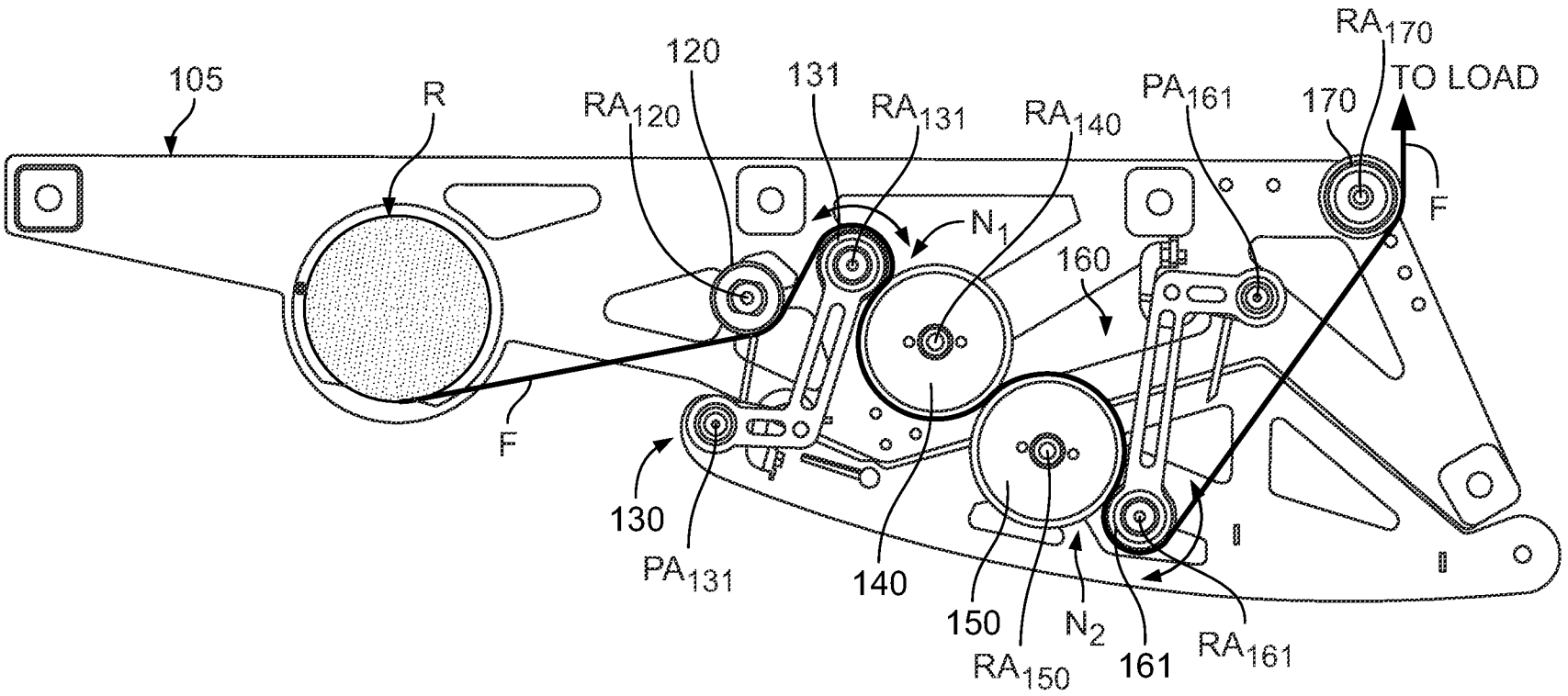
FIG. 5 is a top plan view of the film carriage of FIGS. 3A and 3B with certain components removed. A roll of film is shown rotatably supported by the film carriage, and the path the film takes through the rollers is illustrated.

The film carriage 100 is fixedly connected to the support to move with the support (i.e., rotate relative to the circular guide 20 and move vertically relative to the wrapping-machine frame 10). As best shown in FIG. 5, the film carriage 100 is configured to rotatably support a roll R of film F (such as plastic stretch film). The film carriage 100 includes a film-carriage frame 105, film-reel supports 110*a* and 110*b*, a first idler roller 120, a first pinch-roller assembly 130, a first pre-stretch roller 140, a second pre-stretch roller 150, a second pinch-roller assembly 160, a second idler roller 170, and a pre-stretch drive assembly 180.

The film-carriage frame 105 is formed from multiple tubular and/or solid members (not individually labeled) and configured to support the other components of the film carriage 100. The illustrated film-carriage frame 105 is merely one example configuration, and any suitable configuration may be employed.

Figure 6:
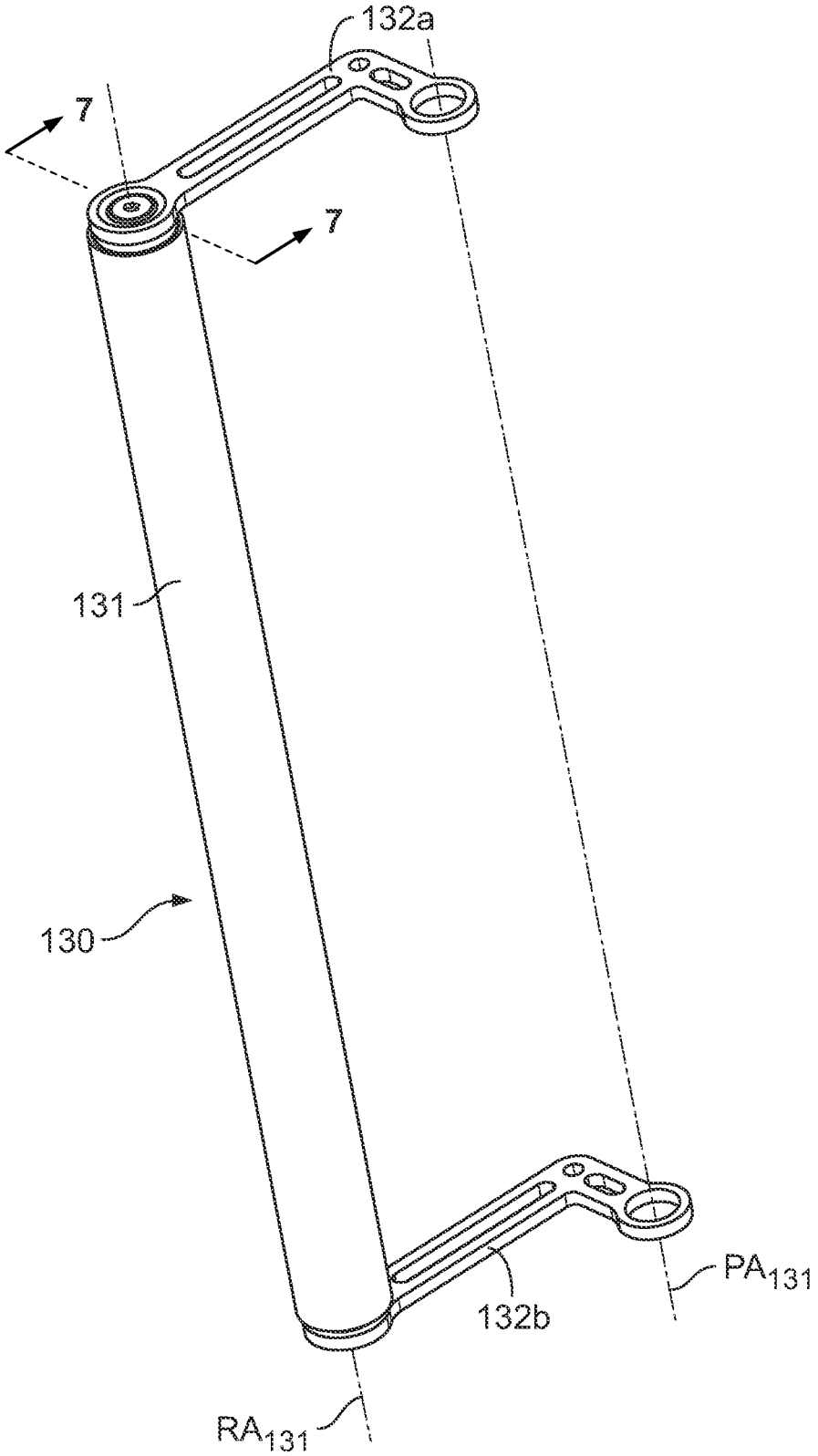
FIG. 6 is a perspective view of the first pinch-roller assembly of the film carriage of FIGS. 3A and 3B.
Figure 7:
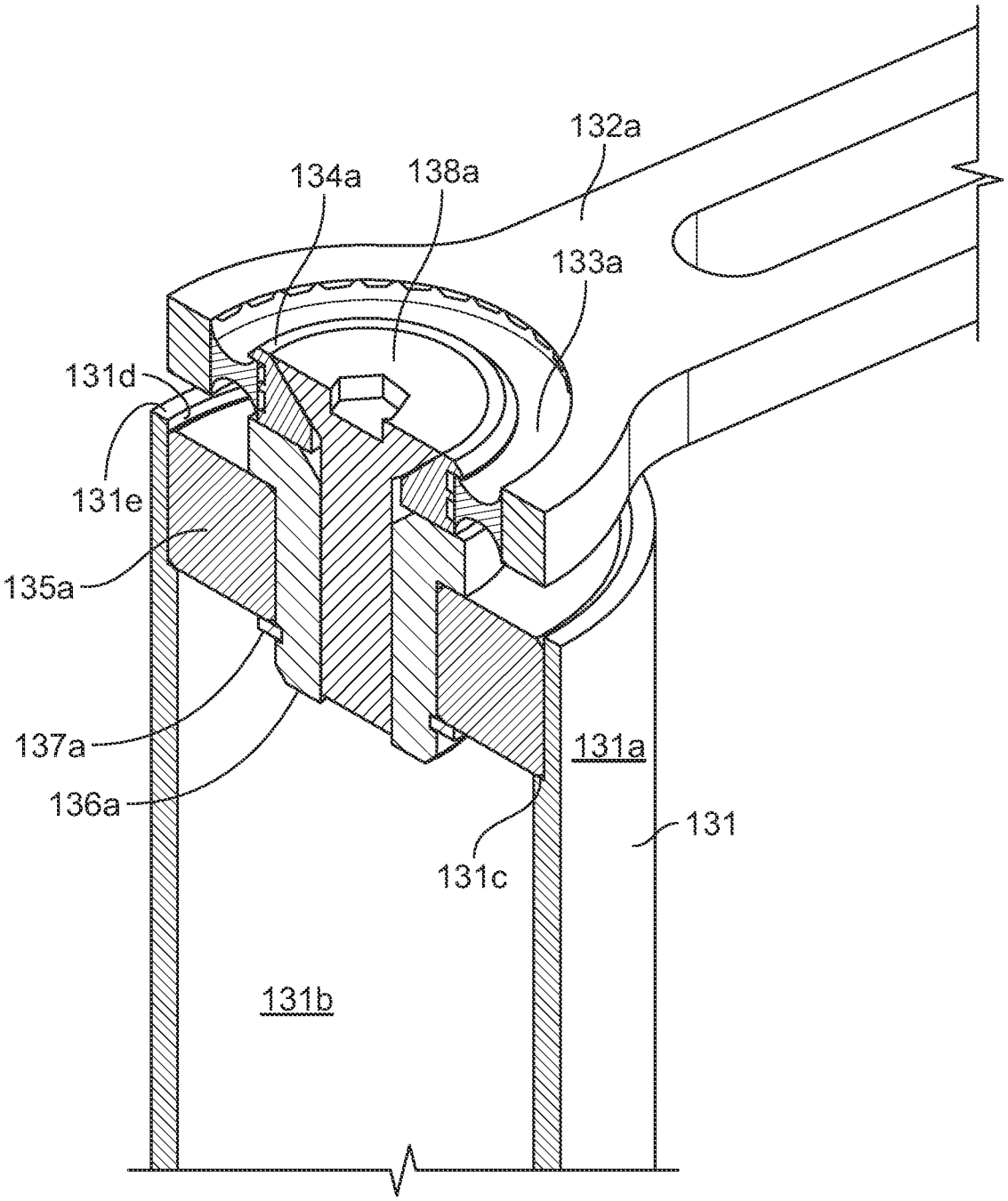
FIG. 7 is a cross-sectional view of part of the first pinch-roller assembly of FIG. 6 taken substantially along line 7-7 of FIG. 6.
Figure 8:
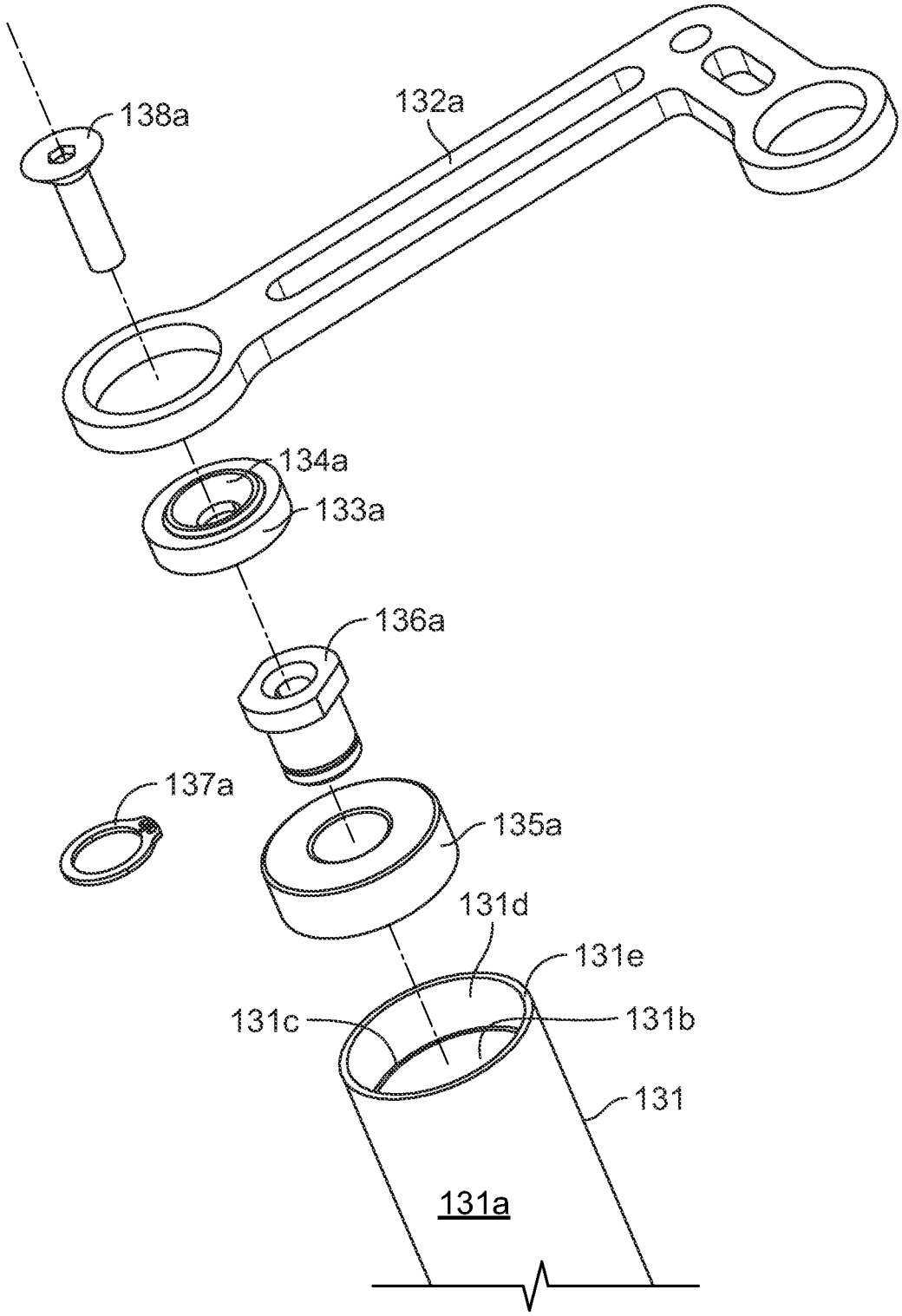
FIG. 8 is an exploded perspective view of the part of the first pinch-roller assembly shown in FIG. 7.

As best shown in FIGS. 6-8, the first pinch-roller assembly 130 includes a first pinch roller 131 having upper and lower arms 132*a* and 132*b* connected to its opposing upper and lower ends, respectively, via upper and lower flexible-connection assemblies (not labeled), respectively. The upper and lower arms 132*a* and 132*b* are connected to the first pinch roller 131 by the upper and lower flexible-connection assemblies in a way that: (1) enables the first pinch roller 131 to freely rotate relative to the upper and lower arms 132*a* and 132*b* about a rotational axis $RA_{131}$ (which in this example embodiment is coaxial with the longitudinal axis of the first pinch roller 131); and (2) enables the first pinch roller 131 to pivot so its rotational axis $RA_{131}$ pivots relative to the upper and lower arms 132*a* and 132*b*.

The upper flexible-connection assembly that connects the upper arm 132*a* to the first pinch roller 131 includes a flexible member 133*a* (here, an annular, deformable, and resilient elastomeric grommet formed from vulcanized rubber); a fastener seat 134*a*; an annular bearing 135*a*; a threaded insert 136*a*; a retaining ring 137*a*; and a fastener 138*a*.

As best shown in FIG. 7, the flexible member 133*a* is positioned in a cylindrical opening in an end of the upper arm 132*a*. The fastener seat 134*a* is positioned in a cylindrical opening defined through center of the flexible member 133*a*. These three components are attached to one another in any suitable manner (such as via interference fit, via adhesives, via fasteners, and the like).

The bearing 135*a* is press-fit into a throughbore defined in one end of the upper arm 132*a*. The threaded insert 136*a* includes a cylindrical body (not labeled) and a cylindrical head (not labeled) at one end of the body. The head of the threaded insert 136*a* has a greater diameter than the body of the threaded insert 136*a*. A threaded throughbore (not labeled) is defined in the center of the head and the body of the threaded insert 136*a*. A circumferential groove is defined in the outer surface of the body of the threaded insert 136*a* near the end of the body opposite the head. The body of the threaded insert 136*a* is positioned in the throughbore defined in the center of the inner race (not shown) of the bearing 135*a* so the groove is outside the throughbore and so the underside of the head of the threaded insert 136*a* abuts the upper surface of the inner race of the bearing 135*a*. The retaining ring 137*a* is installed in the groove to retain the threaded insert in place on the bearing 135*a*.

The bearing 135*a* is positioned in a top end of the first pinch roller 131. More specifically, as shown in FIGS. 7 and 8, the first pinch roller 131 includes an outer cylindrical surface 131*a*, first and second inner cylindrical surfaces 131*b* and 131*d* radially separated by an annular lip 131*c*, and an annular upper-end surface 131 connecting the outer cylindrical surface 131*a* and the second inner cylindrical surface 131*d*. The bearing 135*a* is positioned so its bottom surface engages and is supported by the lip 131*c* of the first pinch roller 131. The bearing 135*a* is held in place inside the first pinch roller 131 against rotation and translation via interference fit of its outer race (not shown) and the second inner cylindrical surface 131*d* of the first pinch roller 131.

The fastener 138*a* connects the upper arm 132*a* to the first pinch roller 131. Specifically, the head (not labeled) of the fastener 138*a* is seated in the fastener seat 134*a*, and the shank (not labeled) of the fastener 138*a* is threadably received in the threaded throughbore defined in the threaded insert 136*a*.

Although not shown to avoid repetition, the lower arm 132*b* is flexibly connected to the first pinch roller 131 via the lower flexible-connection assembly in the same (or a similar) way. The bearings of the flexible-connection assemblies enable the first pinch roller 131 to freely rotate relative to the upper and lower arms 132*a* and 132*b* in response to an appropriate force (such as the film being pulled off the roll, as described below). The fact that the flexible members are deformable enables the first pinch roller 131 to pivot so its rotational axis $RA_{131}$ pivots relative to the upper and lower arms 132*a* and 132*b* in response to an appropriate force. And since the flexible members are resilient, they revert back to their original shapes (thereby pivoting the first pinch roller back to its original orientation) when that force is removed.

The second pinch-arm assembly 160 is identical (or similar) to the first pinch-arm assembly 130. While the components of the second pinch-arm assembly 160 are not separately described to avoid repetition, those components are referenced using the same numbering convention as used for the first pinch-arm assembly 130, with the leading "13" replaced by a leading "16."

Figure 3A:
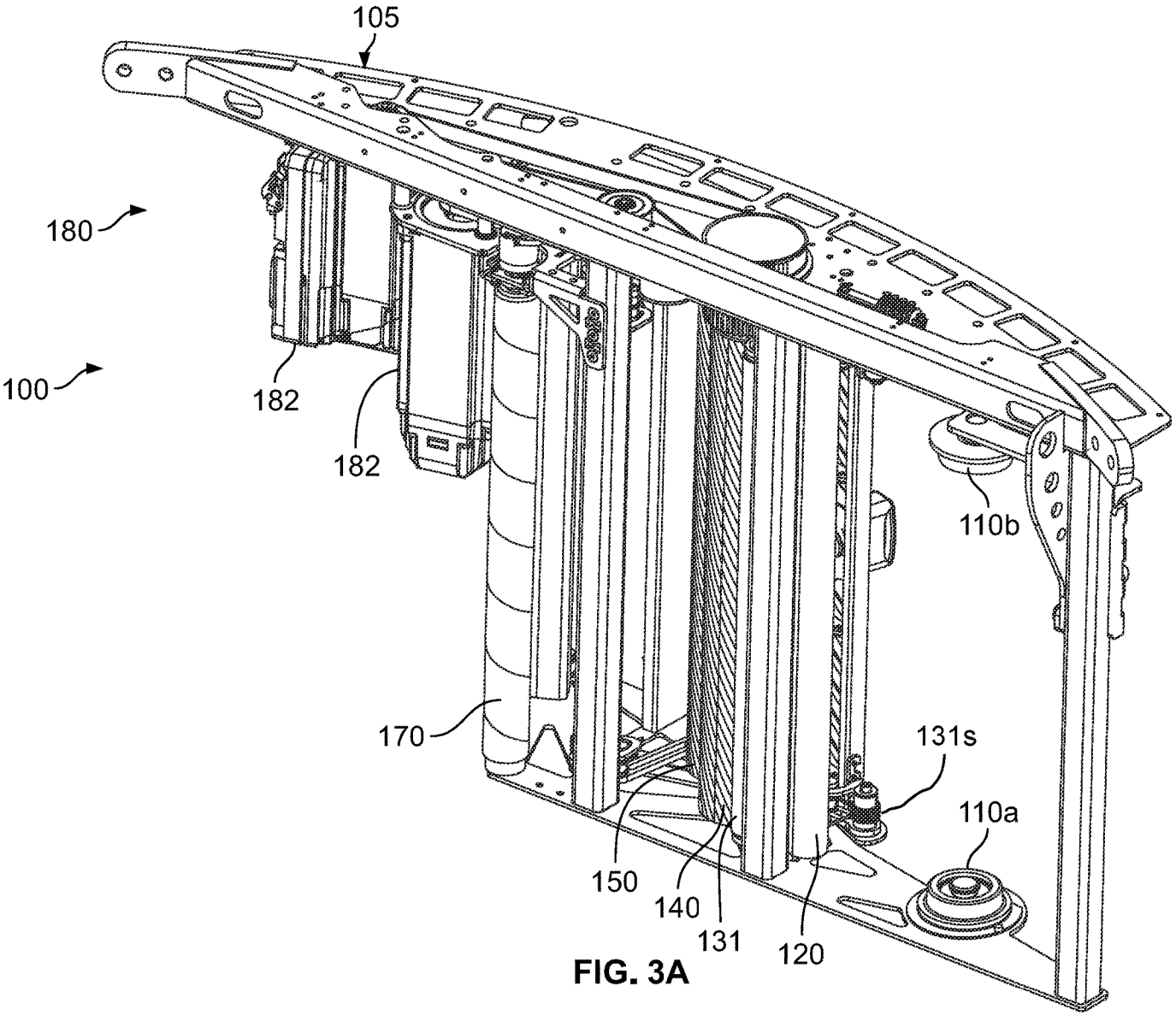
FIGS. 3A and 3B are perspective views of the film carriage of the wrapping assembly of the stretch-wrapping machine of FIG. 1.
Figure 3B:
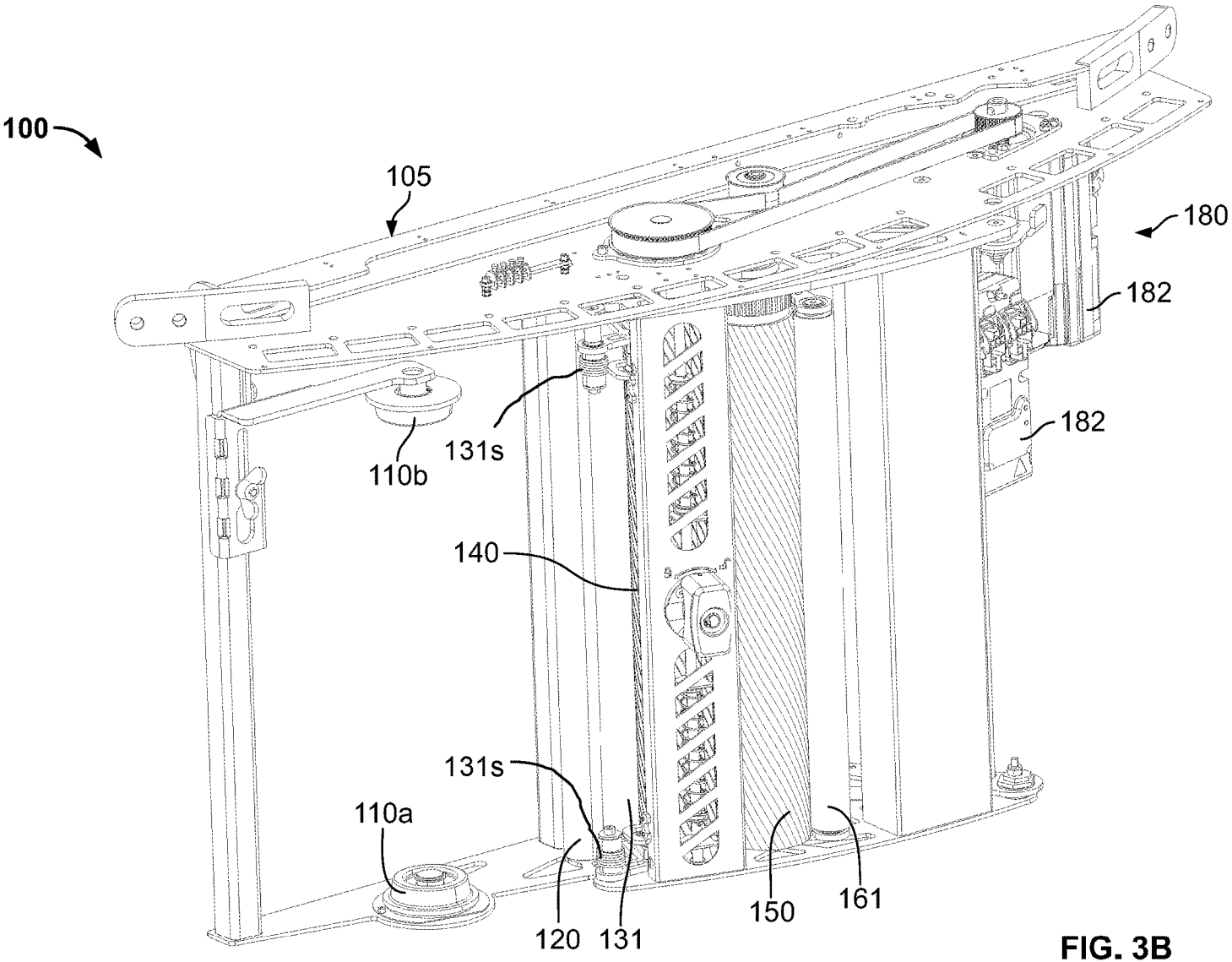
Figure 4:
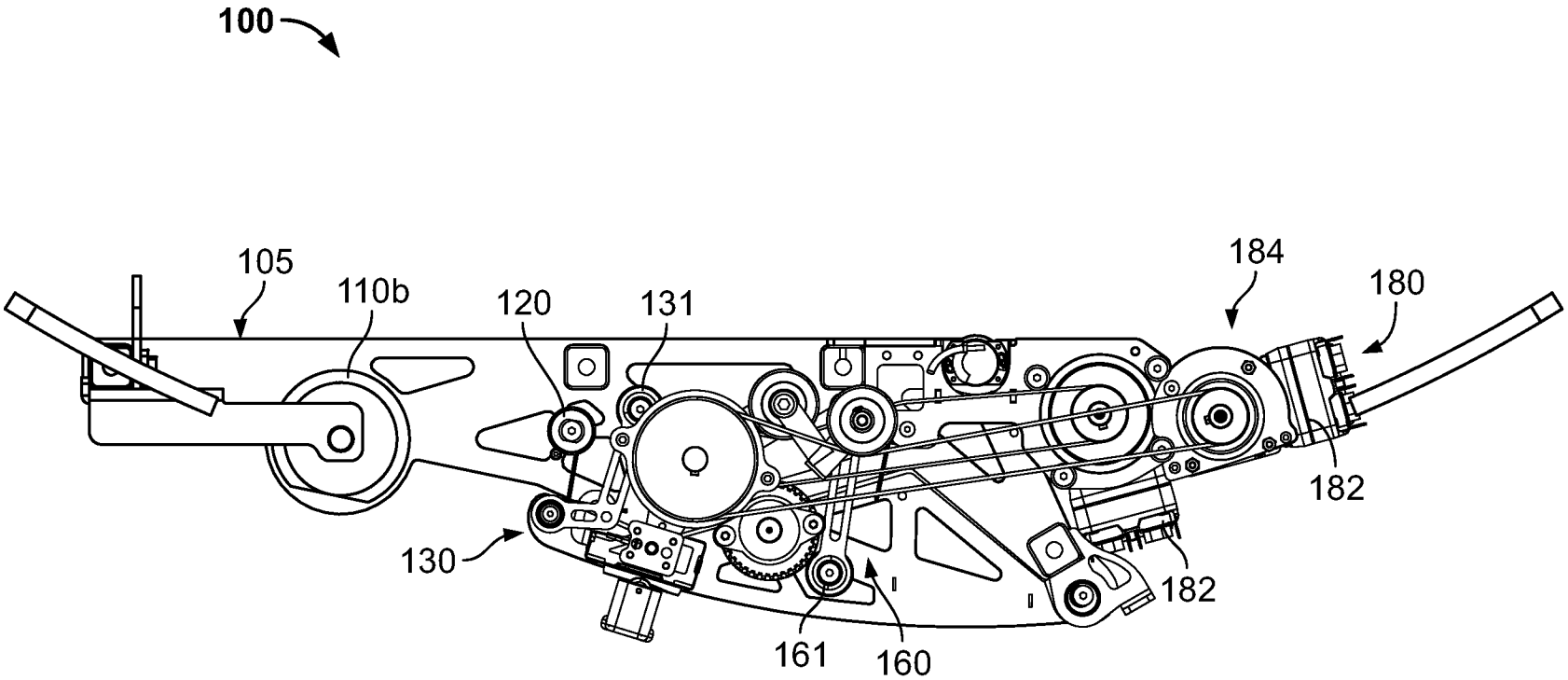
FIG. 4 is a top plan view of the film carriage of FIGS. 3A and 3B with certain components removed.

The pre-stretch drive assembly 180 is best shown in FIGS. 3-4 and is configured to drive the pre-stretch rollers 140 and 150 in a way that pre-stretches the film F as it travels between those pre-stretch rollers, as is known in the art. The pre-stretch drive assembly 180 includes pre-stretch actuators 182 operably connected to the pre-stretch rollers 140 and 150 via a drive train 184. The pre-stretch actuators 182 include electric motors in this example embodiment, though they may be any suitable actuators in other embodiments. The drive train 184 includes several components, such as gears, gear pulleys, belts, and the like, that convert the output of the pre-stretch actuators 182 into rotation of the first and second pre-stretch rollers 140 and 150. The pre-stretch actuators 182 are operably connected to the pre-stretch rollers 140 and 150 to rotate the rollers at different rotational speeds. This causes the film F to pre-stretch as it is drawn through the pre-stretch rollers as the support 100 rotates around the load L.

FIG. 5 shows the relative positions of the rollers of the film carriage 100. As used herein, "downstream" means the direction of travel of the film F as the film is pulled off the roll R and "upstream" means the direction opposite the direction of travel of the film F as the film is pulled off the roll R. The film-reel supports 110*a* and 110*b* are mounted near one end of the film-carriage frame 105 so a roll R of film F can be rotatably mounted to the film-reel supports. The first idler roller 120 is rotatably mounted (such as via bearings) to the film-carriage frame 105 downstream of the film-reel supports 110*a* and 110*b* so the first idler roller 120 can freely rotate relative to the film-carriage frame 105 about a rotational axis $RA_{120}$. The first pre-stretch roller 140 is rotatably mounted (such as via bearings and/or components of the drive train 184) to the film-carriage frame 105 downstream of the first idler roller 120 so the first pre-stretch roller 140 can freely rotate relative to the film-carriage frame 105 (and under control of the pre-stretch drive assembly 180) about a rotational axis $RA_{140}$.

The first pinch-roller assembly 130 is pivotably mounted to the film-carriage frame 105 at the ends of the upper and lower arms 132*a* and 132*b* opposite the ends connected to the first pinch roller 131 so the first pinch roller 131 is pivotable (relative to the first pre-stretch roller 140 and several other components of the film carriage) about a pivot axis $PA_{131}$ between an engaged position (FIG. 5) and a disengaged position (not shown). When in the engaged position, part of the outer surface 131*a* of the first pinch roller 131 engages part of the outer surface of the first pre-stretch roller 140 (or when the film F is between these rollers, presses the film F against the outer surface of the first pre-stretch roller 140). When in the disengaged position, the first pinch roller 131 does not engage the first pre-stretch roller 140. One or more first biasing elements 131*s* (FIGS. 3A and 3B) bias the first pinch roller 131 to its engaged position. As explained above, the first pinch roller 131 is freely rotatable relative to the upper and lower arms 132*a* and 132*b* about the rotational axis $RA_{131}$.

The second pre-stretch roller 150 is rotatably mounted (such as via bearings and/or components of the drive train 184) to the film-carriage frame 105 downstream of the first pre-stretch roller 140 so the second pre-stretch roller 150 can freely rotate relative to the film-carriage frame 105 (and under control of the pre-stretch drive assembly 180) about a rotational axis $RA_{150}$. A slight gap (not labeled) exists between the first and second pre-stretch rollers 140 and 150 to enable the film F to pass between them. The second pinch-roller assembly 160 is pivotably mounted to the film-carriage frame 105 at the ends of the upper and lower arms 162*a* and 162*b* opposite the ends connected to the second pinch roller 161 so the second pinch roller 161 is pivotable (relative to the second pre-stretch roller 150 and several other components of the film carriage) about a pivot axis $PA_{161}$ between an engaged position (FIG. 5) and a disengaged position (not shown). When in the engaged position, part of the outer surface 161*a* of the second pinch roller 161 engages part of the outer surface of the second pre-stretch roller 150 (or when the film F is between these rollers, presses the film F against the outer surface of the second pre-stretch roller 150). When in the disengaged position, the second pinch roller 161 does not engage the second pre-stretch roller 150. One or more second biasing elements (similar to the first biasing elements 131*s* but not shown) bias the second pinch roller 161 to its engaged position. The second pinch roller 161 is freely rotatable relative to the upper and lower arms 162*a* and 162*b* about the rotational axis $RA_{161}$.

The second idler roller 170 is rotatably mounted (such as via bearings) to the film-carriage frame 105 downstream of the second pinch roller 161 so the second idler roller 170 can freely rotate relative to the film-carriage frame 105 about a rotational axis $RA_{170}$.

As shown in FIG. 5, the film F extends from the reel R and contacts the first idler roller 120. The film F then passes around the first pinch roller 131 and through a nip $N_1$ formed between the first pinch roller 131 and the first pre-stretch roller 140. The film passes around the first pre-stretch roller 140 (the outer surface of which may have a high-friction coating), onto and around the second pre-stretch roller 150 (the outer surface of which may have a high-friction coating), and through a nip $N_2$ formed between the second pre-stretch roller and the second pinch roller 161. The film then passes around the second pinch roller 161 and onto the second idler roller 170 before exiting the film carriage 100 and contacting the load L. The film F thus winds around the rollers in a serpentine-like manner so: (1) a first surface of the film F contacts the first idler roller 120, the first pre-stretch roller 140, the second pinch roller 161, and the second idler roller 130; and (2) a second surface of the film F opposite its first surface contacts the first pinch roller 131 and the second pre-stretch roller 150.

As explained above, the differing rotational velocities of the pre-stretch rollers causes the film F to pre-stretch as it travels through the rollers. The first and second pinch rollers 131 and 161 are an integral part of this pre-stretching process because they press the film F against the first and second pre-stretch rollers 140 and 150, respectively. This ensures the film F maintains contact with the pre-stretch rollers long enough to achieve the desired amount of pre-stretch. One problem with certain prior art stretch-wrapping machines is that slight misalignments of the rollers (caused by, for instance, an imprecisely manufactured component or an imprecisely installed component) can create a gap between part of a pinch roller and part of its corresponding pre-stretch roller that is larger than the thickness of the film. In these instances, the pre-stretch roller does not press the film onto the pre-stretch roller along the entire width of the film. This is detrimental because the "floating" film that is not pressed onto the pre-stretch roller will experience a different level of pre-stretch than the remaining film (since less of it contacts the pre-stretch rollers and slipping may occur), leading to a suboptimal wrapped product.

Figure 9A:
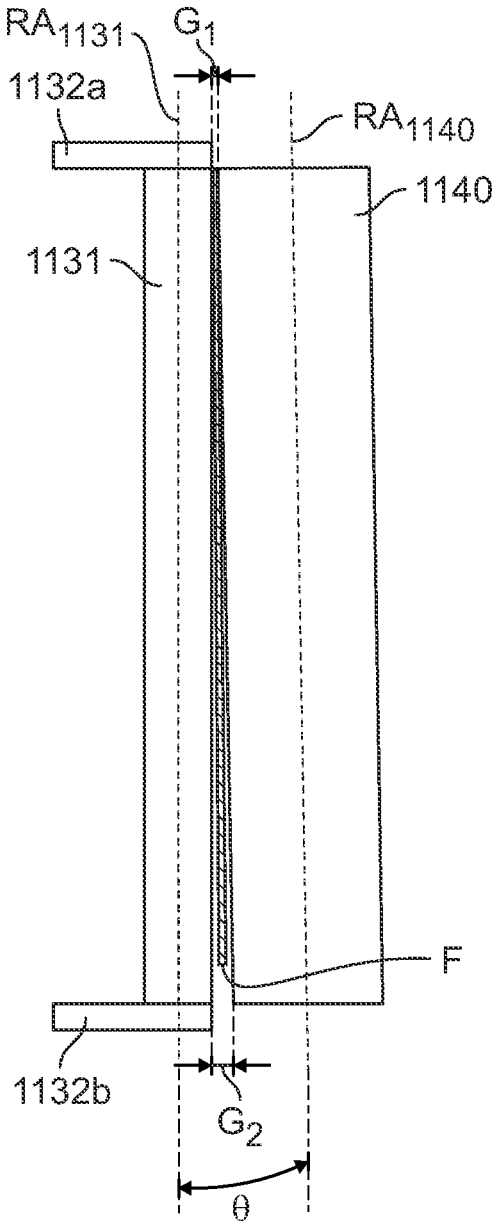
FIG. 9A (Prior Art)
FIG. 9A is an elevational view of part of a pinch roller and part of a pre-stretch roller of a prior art stretch-wrapping machine. The pinch roller and the pre-stretch roller are misaligned.

FIG. 9A shows an example prior art stretch-wrapping machine with a pinch roller 1131*a* rigidly mounted to upper and lower arms 1132*a* and 1132*b* and positioned adjacent to a pre-stretch roller 1140. In this example, the pinch roller 1131*a* and its rotational axis $RA_{131}$ are vertically oriented, while the pre-stretch roller 1140 is slightly misaligned and angled toward the pinch roller 1131*a* at an angle θ. A gap $G_1$ that is about equal to the thickness of the film F exists between the upper ends of the rollers, and (due to the misalignment) a larger gap $G_2$ that is greater than the thickness of the film F exists between the lower ends of the rollers. The pinch roller 1131*a* therefore does not press the film F against the pre-stretch roller 1140 near the bottoms of the rollers, and that portion of the film F will thus be pre-stretched to a different extent (if at all) relative to the other portion of the film F pressed against the pre-stretch roller 1140.

The wrapping machine 1 of the present disclosure solves this problem via the flexible-connection assemblies that connect the arms of the pinch-roller assemblies to their corresponding pinch rollers. As explained above, the flexible members of the flexible-connection assemblies are deformable so as to enable the pinch rollers to pivot so their rotational axes pivot relative to their respective upper and lower arms. This enables the pinch rollers to align themselves with their respective pre-stretch rollers under the force of the biasing elements to compensate for any misalignment between the rollers (for instance, if their rotational axes are not parallel).

Figure 9B:
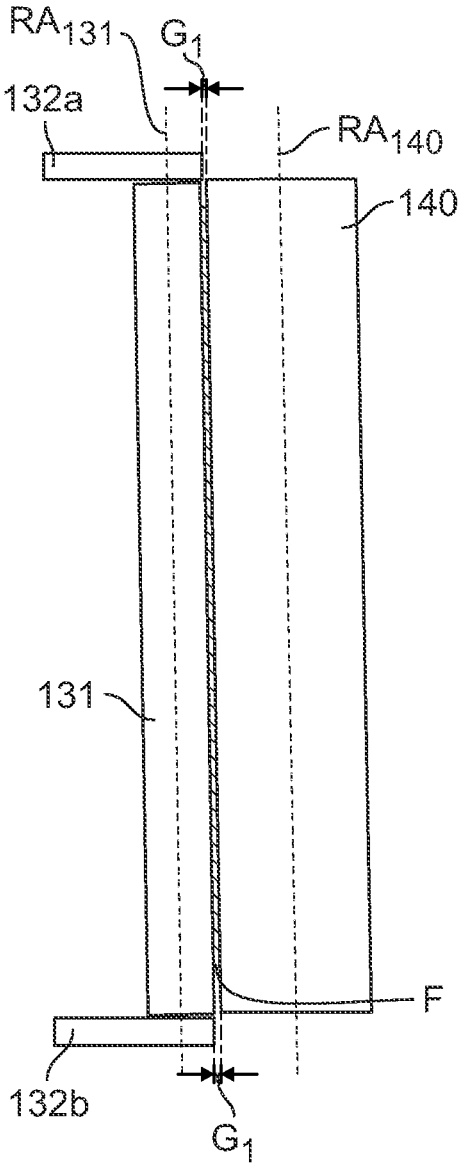
FIG. 9B is an elevational view of part of the first pinch roller of the first pinch-roller assembly of FIG. 6 and of part of the first pre-stretch roller of the film carriage of FIGS. 3A and 3B. The first pinch roller has reoriented itself to compensate for the misalignment of the first pre-stretch roller.

For example, FIG. 9B shows the first pinch roller 131, the upper and lower arms 132*a* and 132*b*, and the first pre-stretch roller 140. For comparison purposes, the first pre-stretch roller 140 is misaligned in the same way as the pre-stretch roller 1140 described above and shown in FIG. 9A. But as shown in FIG. 9B, the elastomeric flexible member enables the first pinch roller 131 to pivot to align itself with the first pre-stretch roller 140 to pinch the film F against the first pre-stretch roller 140 along the entire width of the film F, thereby ensuring the film F will be pre-stretched across its entire width. More specifically, the biasing elements bias the upper and lower arms 132*a* and 132*b* and the pinch roller 131 toward the first pre-stretch roller 140. Since the first pre-stretch roller 140 is angled toward the first pinch roller 131, the upper end of the first pre-stretch roller 140 first contacts the film F and pinches it against the first pre-stretch roller 140, stopping the movement of the upper arm 132*a*. But since the lower end of the first pre-stretch roller 140 is further away from the first pinch roller 131, the lower arm 132*a* continues to move (under the force of the biasing element) until it contacts the film F and pinches it against the first pre-stretch roller 140. The flexible members enable this additional movement of the lower arm 132*b*, and as a result the first pinch roller 131 pivots relative to the upper and lower arms 132*a* and 132*b* so its rotational axis $RA_{131}$ is parallel to the rotational axis $RA_{140}$ of the first pre-stretch roller 140.

The cutting-and-fixing device (not shown) is supported by the wrapping-machine frame 10 and configured to, after the load L has been wrapped, cut the film F from the roll R to form a trailing end of the film F and to connect the trailing end to the wrapped load L to complete the wrapping process. Cutting the film F also creates a leading end of the film F on the roll R. The cutting-and-fixing device is also configured to hold the leading end after cutting the film F and to connect the leading end to the next load as it is being wrapped. The cutting-and-fixing device may be any suitable conventional cutting-and-fixing device known in the art.

The wrapping-assembly actuator 400 is operably connected to the wrapping assembly 40 to rotate the wrapping assembly 40 relative to the circular guide 20 and the load L. In certain embodiments, the wrapping-assembly actuator 400 includes one or more motors operably connected to the wrapping assembly 40 via one or more belt-and-pulley assemblies to rotate the wrapping assembly 40 relative to the circular guide 20 and the load L. This is merely an example, and the wrapping-assembly actuator 400 may include any suitable actuator configured to rotate the wrapping assembly 40 relative to the circular guide 20 and the load L.

The operator interface 50 is configured to receive inputs from an operator and, in certain embodiments, to output information to the operator. The operator interface includes one or more input devices configured to receive inputs from the operator. In various embodiments, the one or more input devices include one or more buttons (such as hard or soft keys), one or more switches, and/or a touch panel. In various embodiments, the operator interface 50 includes a display device configured to display information to the operator, such as information about the palletized load, the status of the wrapping operation, or the parameters of the wrapping machine 1. The operator interface may include other output devices instead of or in addition to the display device, such as one or more speakers and/or one or more lights. In certain embodiments, the operator interface 50 is formed as part of the wrapping machine 1 and is, for instance, mounted to the wrapping-machine frame 10. In other embodiments, the operator interface is remote from the wrapping machine 1.

The controller 60 includes a processing device communicatively connected to a memory device. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the wrapping machine 1 (such as to carry out a wrapping operation, as described below).

The controller 60 is communicatively and operably connected to the guide actuator 30, the cutting-and-fixing device, the pre-stretch actuators 182, and the wrapping-assembly actuator 400 to control operation of these components in conjunction with the wrapping operation, as described below. The controller 60 is communicatively connected to the operator interface 50 to: (1) receive signals from the operator interface 50 that represent inputs received by the operator interface 50; and (2) send signals to the operator interface 50 to cause the operator interface 50 to output (such as to display) information.

A wrapping operation in which the wrapping machine 1 is used to wrap the load L with the film F to secure the load L to the pallet P is now described. Initially, the circular guide 20 is at its upper position, and the cutting-and-fixing device holds the leading end of the film F on the roll R. The controller 60 controls the conveyor C to move the load L on the pallet P through the infeed area 10*a* and into the wrapping area of the wrapping machine 1. After the load L on the pallet P reaches the wrapping area, the controller 60 controls the guide actuator 30 to lower the circular guide 20 such that the wrapping assembly 40 is at least partially vertically aligned with part of the load L. The controller 60 controls the cutting-and-fixing device to hold the leading end of the film F against the load L while controlling the wrapping-assembly actuator 400 to rotate the wrapping assembly 40 relative to the circular guide 20 and the load L. The rotation of the wrapping assembly 40 relative to the load L combined with the cutting-and-fixing device holding the leading end of the film F against the load L causes the film F to be drawn off of the roll R, directed through the rollers of the film carriage 100, and wrapped around the load L.

Once the film F has been wrapped around the leading end, the controller 60 controls the cutting-and-fixing device to release the leading end and move away from the load L. The controller 60 continues to control the wrapping-assembly actuator 400 to rotate the wrapping assembly 40 while controlling the guide actuator 30 to vertically move the circular guide 20 such that the load L is wrapped with the film F in a spiral pattern. During wrapping the controller 60 controls the pre-stretch actuators 182 to rotate the first and second pre-stretch rollers 140 and 150 at different rotational speeds to pre-stretch the film F as it is drawn through the rollers. After wrapping is complete, the controller 60 controls the cutting-and-fixing device to cut the film F from the roll and secure the trailing end of the film F to the load L, thereby completing the wrapping operation. The controller 60 controls the conveyor C to move the wrapped load L and pallet P from the wrapping area and through the outfeed area 10*b*.

Various embodiments of the present disclosure provide a wrapping machine comprising: a wrapping-machine frame; a guide mounted to the wrapping machine frame; a guide actuator operably connected to the guide to move the guide vertically relative to the wrapping-machine frame; a wrapping assembly mounted to the guide and comprising a film carriage; and a wrapping-assembly actuator operably connected to the wrapping assembly to move the wrapping assembly relative to the guide. The film carriage comprises a film-carriage frame; a first pre-stretch roller rotatably mounted to the film-carriage frame; a first pinch-roller assembly comprising an arm and a first pinch roller having a first-pinch-roller rotational axis; and a first biasing element biasing the first pinch roller to an engaged position. The first pinch roller is connected to the arm so: (1) the first pinch roller is rotatable relative to the arm about the first pinch roller rotational axis; and (2) the first pinch roller is pivotable relative to the arm to pivot the first-pinch-roller rotational axis relative to the arm. The first pinch-roller assembly is pivotably mounted to the film-carriage frame by the arm so the first pinch roller is pivotable relative to the first pre-stretch roller between its engaged position in which the first pinch roller engages the first pre-stretch roller and a disengaged position in which the first pinch roller is disengaged from the first pre-stretch roller.

In certain such embodiments, the first pinch-roller assembly further comprises a flexible-connection assembly that connects the arm to the first pinch roller.

In certain such embodiments, the flexible-connection assembly comprises a deformable flexible member.

In certain such embodiments, the flexible member is formed from a resilient elastomeric material.

In certain such embodiments, the first pinch-roller assembly further comprises a second arm connected to the first pinch roller.

In certain such embodiments, the first biasing element imparts a first biasing force on the arm that biases the first pinch roller to its engaged position, and the film carriage further comprises a second biasing element that imparts a second biasing force on the second arm that biases the first pinch roller to its engaged position.

In certain such embodiments, the arm and the second arm are independently movable to cause the first pinch roller to rotate relative to the arm and the second arm so the first-pinch-roller rotational axis rotates relative to the arm and the second arm.

Various embodiments of the present disclosure provide the film carriage of the above-described wrapping machine.

The invention claimed is:

1. A wrapping machine comprising:

a wrapping-machine frame;

a guide mounted to the wrapping machine frame;

a guide actuator operably connected to the guide to move the guide vertically relative to the wrapping-machine frame;

a wrapping assembly mounted to the guide and comprising a film carriage, the film carriage comprising:

a film-carriage frame;

a first pre-stretch roller rotatably mounted to the film-carriage frame;

a first pinch-roller assembly comprising an arm and a first pinch roller having a first-pinch-roller rotational axis, wherein the first pinch roller is connected to the arm so: (1) the first pinch roller is rotatable relative to the arm about the first pinch roller rotational axis; and (2) the first pinch roller is pivotable relative to the arm to pivot the first-pinch-roller rotational axis relative to the arm, wherein the first pinch-roller assembly is pivotably mounted to the film-carriage frame by the arm so the first pinch roller is pivotable relative to the first pre-stretch roller between an engaged position in which the first pinch roller engages the first pre-stretch roller and a disengaged position in which the first pinch roller is disengaged from the first pre-stretch roller; and a first biasing element biasing the first pinch roller to its engaged position; and a wrapping-assembly actuator operably connected to the wrapping assembly to move the wrapping assembly relative to the guide.

2. The wrapping machine of claim 1, wherein the first pinch-roller assembly further comprises a flexible-connection assembly that connects the arm to the first pinch roller.

3. The wrapping machine of claim 2, wherein the flexible-connection assembly comprises a deformable flexible member.

4. The wrapping machine of claim 3, wherein the flexible member is formed from a resilient elastomeric material.

5. The wrapping machine of claim 4, wherein the first pinch-roller assembly further comprises a second arm connected to the first pinch roller.

6. The wrapping machine of claim 5, wherein the first biasing element imparts a first biasing force on the arm that biases the first pinch roller to its engaged position, the film carriage further comprising a second biasing element that imparts a second biasing force on the second arm that biases the first pinch roller to its engaged position.

7. The wrapping machine of claim 6, wherein the arm and the second arm are independently movable to cause the first pinch roller to rotate relative to the arm and the second arm so the first-pinch-roller rotational axis rotates relative to the arm and the second arm.

8. A film carriage for a wrapping machine, the film carriage comprising:

a film-carriage frame;

a first pre-stretch roller rotatably mounted to the film-carriage frame;

a first pinch-roller assembly comprising an arm and a first pinch roller having a first-pinch-roller rotational axis, wherein the first pinch roller is connected to the arm so:

(1) the first pinch roller is rotatable relative to the arm about the first pinch roller rotational axis; and (2) the first pinch roller is pivotable relative to the arm to pivot the first-pinch-roller rotational axis relative to the arm, wherein the first pinch-roller assembly is pivotably mounted to the film-carriage frame by the arm so the first pinch roller is pivotable relative to the first pre-stretch roller between an engaged position in which the first pinch roller engages the first pre-stretch roller and a disengaged position in which the first pinch roller is disengaged from the first pre-stretch roller; and a first biasing element biasing the first pinch roller to its engaged position.

9. The film carriage of claim 8, wherein the first pinch-roller assembly further comprises a flexible-connection assembly that connects the arm to the first pinch roller.

10. The film carriage of claim 9, wherein the flexible-connection assembly comprises a deformable flexible member.

11. The film carriage of claim 10, wherein the flexible member is formed from a resilient elastomeric material.

12. The film carriage of claim 11, wherein the first pinch-roller assembly further comprises a second arm connected to the first pinch roller.

13. The film carriage of claim 12, wherein the first biasing element imparts a first biasing force on the arm that biases the first pinch roller to its engaged position, the film carriage further comprising a second biasing element that imparts a second biasing force on the second arm that biases the first pinch roller to its engaged position.

14. The film carriage of claim 13, wherein the arm and the second arm are independently movable to cause the first pinch roller to rotate relative to the arm and the second arm so the first-pinch-roller rotational axis rotates relative to the arm and the second arm.

* * * * *